US005554820A

United States Patent [19]

Wardle et al.

[11] Patent Number: 5,554,820

[45] Date of Patent: Sep. 10, 1996

[54] HIGH SOLIDS ROCKET MOTOR PROPELLANTS USING DIEPOXY CURING AGENTS

[75] Inventors: Robert B. Wardle, Logan; R. Scott Hamilton, Bear River City, both of Utah

[73] Assignee: Thiokol Corporation, Ogden, Utah

[21] Appl. No.: 406,573

[22] Filed: Mar. 20, 1995

[51] Int. Cl.[6] ..... C06B 45/10

[52] U.S. Cl. ..... 149/19.9; 149/19.91; 149/19.6; 149/20; 149/76

[58] Field of Search ..... 149/19.2, 19.9, 149/19.6, 19.5, 19.91, 20, 76; 264/3

[56] References Cited

U.S. PATENT DOCUMENTS

| | | | |
|---|---|---|---|
| 3,259,531 | 6/1966 | Lofberg | 149/2 |
| 3,563,966 | 2/1971 | Lowrey et al. | 260/82.1 |
| 3,595,717 | 7/1971 | Lowrey et al. | 149/19 |
| 3,706,608 | 12/1972 | Geisler | 149/6 |
| 3,716,604 | 2/1973 | Dehm | 264/3 |
| 3,779,825 | 12/1973 | Blackwell | 149/19 |
| 3,830,675 | 8/1974 | Zelinski et al. | 149/19.9 |
| 3,948,698 | 4/1976 | Elrick et al. | 149/19.6 |
| 3,984,265 | 10/1976 | Elrick et al. | 149/19.9 |
| 3,993,514 | 11/1976 | Pacanowsky et al. | 149/19.5 |
| 4,057,441 | 11/1977 | Biddle | 149/19.9 |
| 4,210,474 | 7/1980 | Ramohalli | 149/19.2 |

*Primary Examiner*—Donald P. Walsh
*Assistant Examiner*—John Hardee
*Attorney, Agent, or Firm*—Madson & Metcalf; Ronald L. Lyons

[57] ABSTRACT

A PBAN-based solid rocket motor propellant which includes more than 85% or more solids is provided. Propellants of this nature are possible using the combination of diepoxide curing agents and PBAN as a binder. The curing agents include diepoxides having 4 to about 10 carbon atoms. It has been observed that when a diepoxide curing agent is substituted for conventional curing agents, viscosities are significantly reduced, thus enabling the addition of higher percentages of solids in the propellant formulation. Total solids loading of over 85% are achievable while maintaining end-of-mix viscosities within acceptable ranges.

22 Claims, 3 Drawing Sheets

HIGH SOLIDS ROCKET MOTOR PROPELLANTS USING DIEPOXY CURING AGENTS

BACKGROUND

1. The Field of the Invention

The present invention is related to solid rocket motor propellants and methods for formulating such propellants. More particularly, the present invention relates to solid rocket motor propellants which contain high levels of solids and which incorporate diepoxy curing agents.

2. Technical Background

Solid propellants are used extensively in the aerospace industry. Solid propellants have developed as the preferred method of powering most missiles and rockets for military, commercial, and space applications. Solid rocket motor propellants have become widely accepted because of the fact that they are relatively simple to formulate and use, and they have excellent performance characteristics. Furthermore, solid propellant rocket motors are generally very simple when compared to liquid fuel rocket motors. For all of these reasons, it is found that solid rocket propellants are often preferred over other alternatives, such as liquid propellant rocket motors.

Typical solid rocket motor propellants are generally formulated having an oxidizing agent, a fuel, and a binder. At times, the binder and the fuel may be the same. In addition to the basic components set forth above, it is conventional to add various plasticizers, curing agents, cure catalysts, ballistic catalysts, and other similar materials which aid in the processing and curing of the propellant. A significant body of technology has developed related solely to the processing and curing of solid propellants, and this technology is well known to those skilled in the art.

One type of propellant that is widely used in the solid rocket motor technology incorporates ammonium perchlorate (AP) as the oxidizer. The ammonium perchlorate oxidizer may then, for example, be incorporated into a propellant which is bound together by a polymer binder. Such binders are widely used and commercially available. It has been found that such propellant compositions provide ease of manufacture, relative ease of handling, good performance characteristics and are at the same time economical and reliable. In essence it can be said that ammonium perchlorate composite propellants have been the backbone of the solid propulsion industry for approximately the past 40 years.

In some instances it is necessary to provide high levels of thrust in order to propel the desired payload into space. Such applications include, for example, propellants for use in the space shuttle program. Obviously, the space shuttle is an enormous and complex device that requires extraordinary thrust in order to propel it into earth orbit. At the same time, the propellant used in the space shuttle is not under the same constraints imposed by combat or other specialized propellant uses. In that regard, smoke production is not a major concern. The primary concern is obtaining the maximum thrust per unit of propellant used while maintaining acceptable safety characteristics.

It has been found that an acceptable propellant for such uses is a relatively high solids propellant having a butadiene-acrylonitrile-acrylic acid terpolymer (PBAN) binder. The solids incorporated into the propellant are typically ammonium perchlorate salt as an oxidizer, and aluminum as a metallic fuel. When the propellant is burned, these solid ingredients are the primary contributors to the thrust produced. Propellants of this type are found to produce a high level of thrust per pound of propellant and are preferred for high thrust applications.

A typical PBAN shuttle propellant includes about 84% to 86% by weight solids. In one typical example, the propellant may include about 16% aluminum, 69.75% ammonium perchlorate, and 0.25% iron oxide, for a total solids loading of 86%. The solids are then bound together by the polymeric PBAN binder and a corresponding Bisphenol A-diglycidyl ether curative, which together comprise the remaining 14% of the propellant formulation.

In view of the fact that the solids provide most of the energy output of the propellant, it is desirable to maximize the percentage of solids in the propellant formulation. If it is possible to increase the solids loading by even a few percent, it is possible to obtain marked improvements in energy output. The result of such improvements in performance is that the amount of propellant per pound of payload can be reduced. Thus, a larger payload can be propelled into space, or existing payloads can be propelled more efficiently.

One of the primary problems with PBAN propellants relates to processiblity. High solids PBAN propellants tend to be very viscous. The viscosity of such propellants can rapidly reach unacceptable levels if there is an increase in the level of solids loading. For example, observed end of mix viscosities of PBAN propellants having 86% solids are in the range of 17 to 30 kilopoise (Kp), which are in themselves relatively high and present problems in processing. However, when the solids level is raised even two percent to 88% by weight, the viscosity rises to over 50 Kp. Viscosities in this range are unacceptable because the mixture is not adequately processible.

As mentioned above, the conventional curatives in propellants of this type are based on bisphenol A. It is observed that the combination of PBAN and bisphenol A-based curatives contributes significantly to the high viscosity observed during processing. The high viscosity of the binder-curative combination clearly limits the ability to add solids to the composition.

The high viscosities observed when the solids level reaches or exceeds about 86% makes such propellant formulations unworkable and unacceptable. Propellants having high viscosities will not readily flow, making it difficult to load rocket motors with these materials. In addition, it is often observed that viscous propellants entrap air during processing. Air voids can be dangerous when the propellant is burned, providing hot spots and uneven burning of the propellant. Thus, until now it was not possible to consistently prepare high solids PBAN propellants having solids levels over about 86% by weight.

Accordingly, it would be a significant advancement in the art to provide PBAN propellants having solid levels at or above 86%. In that regard, it would be a significant advancement in the art to provide such propellants which were also processible such that problems of very high viscosity were minimized. It would be a further advancement in the art to provide PBAN-curative combinations which resulted in reduced viscosity and which enabled the propellant to contain additional solids.

Such methods and compositions are disclosed and claimed herein.

BRIEF SUMMARY AND OBJECTS OF THE INVENTION

The present invention relates to PBAN-based solid rocket motor propellants which include 86%, or more, solids.

Specifically, propellants having total solids in the range of from about 86% to about 92% are possible. The present invention also provides methods for preparing such propellants. Propellants of this nature are possible using the inventive combination of diepoxy curing agents and PBAN as a binder. The diepoxy curing agents of the present invention are selected such that they are aliphatic, cycloaliphatic, mono-aromatic, or heterocyclic diepoxides containing from 4 to about 10 carbon atoms.

As was mentioned above, PBAN tends to be a viscous binder material. PBAN is a butadiene-acrylonitrile-acrylic acid terpolymer. When bisphenol A diglycidyl ether (sometimes referred to as "epoxy curing agent" or simply "ECA") is used as a curative for the PBAN binder, high viscosities continue to be observed.

Within the scope of the present invention, it has been observed that when another diepoxide curing agent is substituted for ECA, viscosities are significantly reduced, thus enabling the addition of higher percentages of solids in the propellant formulation.

An example of the present invention involves replacing the PBAN-ECA combination with PBAN and diepoxyoctane. A typical baseline high thrust producing propellant may, for example, consist of 14% by weight binder/ECA, 16% by weight aluminum, 69.75% by weight ammonium perchlorate, and 0.25% iron oxide. End of mix viscosities for this type of formulation generally fall in the range of from about 17 Kp to about 30 Kp. However, when the solids are increased to 88% (such as 20% aluminum and 67.75% ammonium perchlorate) of the formulation, viscosities in excess of 50 Kp are observed.

When the same 88% solids propellant formulation is prepared using diepoxyoctane in place of ECA, end of mix viscosities of about 28 Kp have been observed. The difference in viscosities represents the difference between a mixture having practical applicability and one which is not usable. Even when a cure catalyst, such as magnesium oxide, is used, end of mix viscosities in the range of 35 Kp are observed when diepoxyoctane is selected as the curing agent.

The present invention demonstrates that replacing the bisphenol A based curatives with a diepoxy in PBAN propellants results in significantly reduced end of mix viscosities. This enables one to formulate usable PBAN propellants having solids levels in excess of 86%. This produces a much more efficient and dense propellant. For example, it has been calculated that use of the above-described formulation using ethylene glycol diglycidyl ether would enable the space shuttle payload to be increased by 3,100 to 4,300 pounds, depending on the nozzle design used.

The objects and advantages of the invention as outlined above will become apparent upon reading the following detailed description and appended claims, and upon reference to the accompanying drawings.

BRIEF DESCRIPTION OF THE DRAWINGS

In order to more fully understand the manner in which the above-recited and other advantages and objects of the invention are obtained, a more particular description of the invention briefly described above will be rendered by reference to specific embodiments thereof which are illustrated in the appended drawings. Understanding that these drawings depict only typical performance data obtained when using the invention and are not therefore to be considered limiting of its scope, the invention will be described and explained with additional specificity and detail through the use of the accompanying drawings in which.

DETAILED DESCRIPTION OF THE PREFERRED EMBODIMENTS

Figure 1:
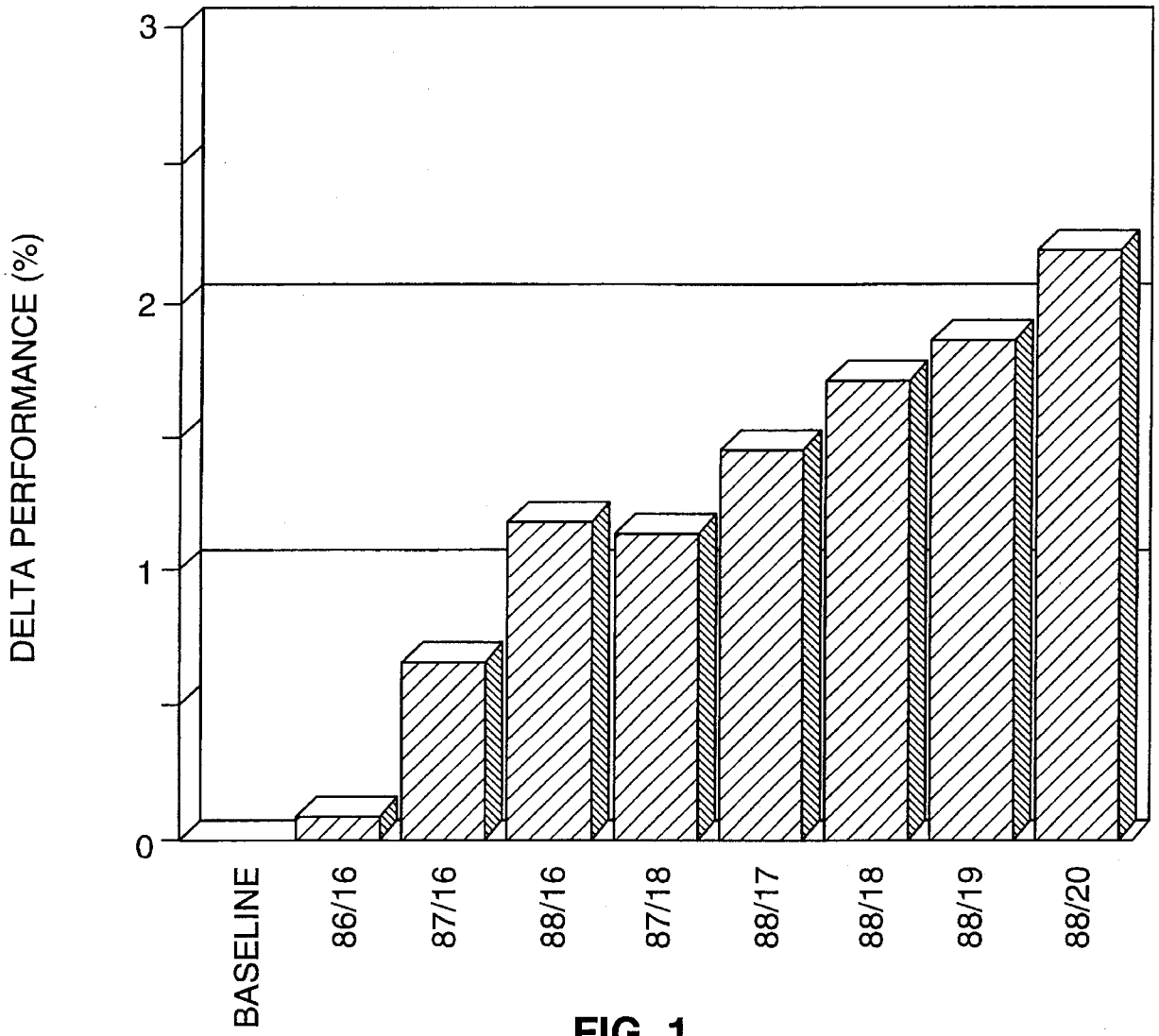
FIG. 1 is a bar graph showing the change in propellant performance by increasing solids and increasing the level of aluminum in a PBAN propellant using diepoxyoctane as the curative.

The present invention relates to the production of high solids loaded PBAN rocket motor propellant. The objective of high solids loading is obtained by replacing the conventional bisphenol A-diglycidyl ether curative with a diepoxy curing agent. By doing so, it is possible to increase the level of solids in the propellant, thereby increasing the performance of the propellant formulation.

The present invention preferably includes from about 86% to about 92% to solids loading. Total solids include solid oxidizer salts, such as ammonium perchlorate, and solid fuels, such as aluminum. Using the present invention it is possible to provide high solids propellants of this type which have end-of-mix viscosities within workable levels. End-of-mix viscosities below 40 Kp are desirable. More particularly, end-of-mix viscosities in the range of from about 20 Kp to about 36 Kp are obtainable. As discussed above, the present invention is particularly useful in connection with PBAN propellant formulations. PBAN is a well known binder used in solid rocket motor technology. PBAN comprises butadiene-acrylonitrile-acrylic acid terpolymer. The polymer results in multiple carboxylic acid terminated sites provided by the acrylic acid component of the polymer. The structures of acrylic acid and the acrylic acid repeating unit within the polymer are as follows:

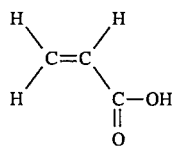

acrylic acid

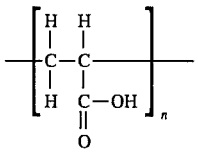

acrylic acid unit

PBAN also includes repeating units provided by the acrylonitrile constituent. The structure of acrylonitrile and the acrylonitrile repeating units are as follows:

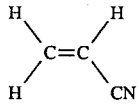

acrylonitrile

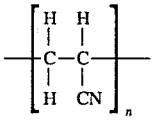

acrylonitrile unit

Finally, PBAN includes a butadiene component. The structure of butadiene and the butadiene repeating units are as follows:

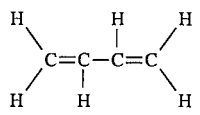

butadiene

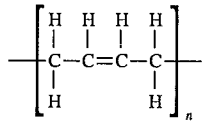

butadiene unit

The cure reaction involves the reaction of a curative with the acid terminus of the acrylic acid repeating units. Generally, an epoxide group reacts with the acrylic acid by protonation of the oxygen atom in the epoxide.

Conventionally, PBAN polymers have been cured by the reaction of bisphenol A-diglycidylether with the carboxylic acid groups of the polymer. The structure of bisphenol A-diglycidylether is as follows:

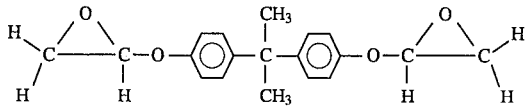

As mentioned above, PBAN cured with bisphenol A-diglycidylether is viscous. This presents a problem when it is desired to load the PBAN binder with the highest possible level of solids. High solids loading simply further exacerbates the viscosity problem.

Accordingly, the present invention provides relief in the form of the use of simpler diepoxy curatives. According to the present invention, diepoxides having 4 to about 10 carbon atoms are preferred, although diepoxides having additional carbon atoms may also be substituted in certain cases. The preferred diepoxides include aliphatic, cycloaliphatic, mono-aromatic, heterocyclic, diglycidyl ether, and dihydric diepoxides having from 4 to about 10 carbon atoms. Examples of such compounds include butadiene diepoxide; 1,2,5,6 diepoxyhexane; diglycidyl ether; diglycidyl ether of 1,4 butanediol; 1,8-bis(2,3 epoxypropoxy) octane; 1,4bis(2,3 epoxypropoxy)cyclohexane. Two presently preferred diepoxides are ethyleneglycol diglycidyl ether and diepoxyoctane (1,2,7,8 diepoxyoctane). Other diepoxides are well known in the art. A partial listing of examples of these diepoxide materials is set forth in U.S. Pat. No. 3,984,265 to Elrick, et al, dated Oct. 5, 1976, which is incorporated herein by this reference.

One important feature of diepoxy curing agents is that they provide efficient curing without causing the viscosity of the binder to increase to unacceptable levels. The curing is efficient in that the functional array of the diepoxy curing agents is similar to ECA. These features are accomplished by choosing diepoxides with are generally simpler in structure than the complex di-aromatic structure of bisphenol A-diglycidylether. They are generally lower in molecular weight and lower in viscosity. As mentioned above, this allows for higher solids loading of the propellant. This results in propellants which are generally more dense, have a higher burn rate, and are capable of propelling larger payloads.

The Figures illustrate the performance which can be achieved by employing the present invention. FIG. 1 is a bar graph illustrating the effect on propellant performance of replacing ECA with diepoxyoctane. Propellant performance for the purposes of this Figure is defined as specific impulse (Isp) times density (dens.) to a specific power (0.6). This is designated Isp*dens.^0.6 in FIG. 2.

In FIG. 1, the X axis designates the percentage total solids in the propellant and the percentage of aluminum. For example the designation 86/16 indicates 86% total solids and 16% aluminum. It will be appreciated from FIG. 1 that improved performance can be achieved using the present invention. For example, each 1% improvement in performance provides significantly greater payload capacity in the typical space shuttle.

Figure 2:
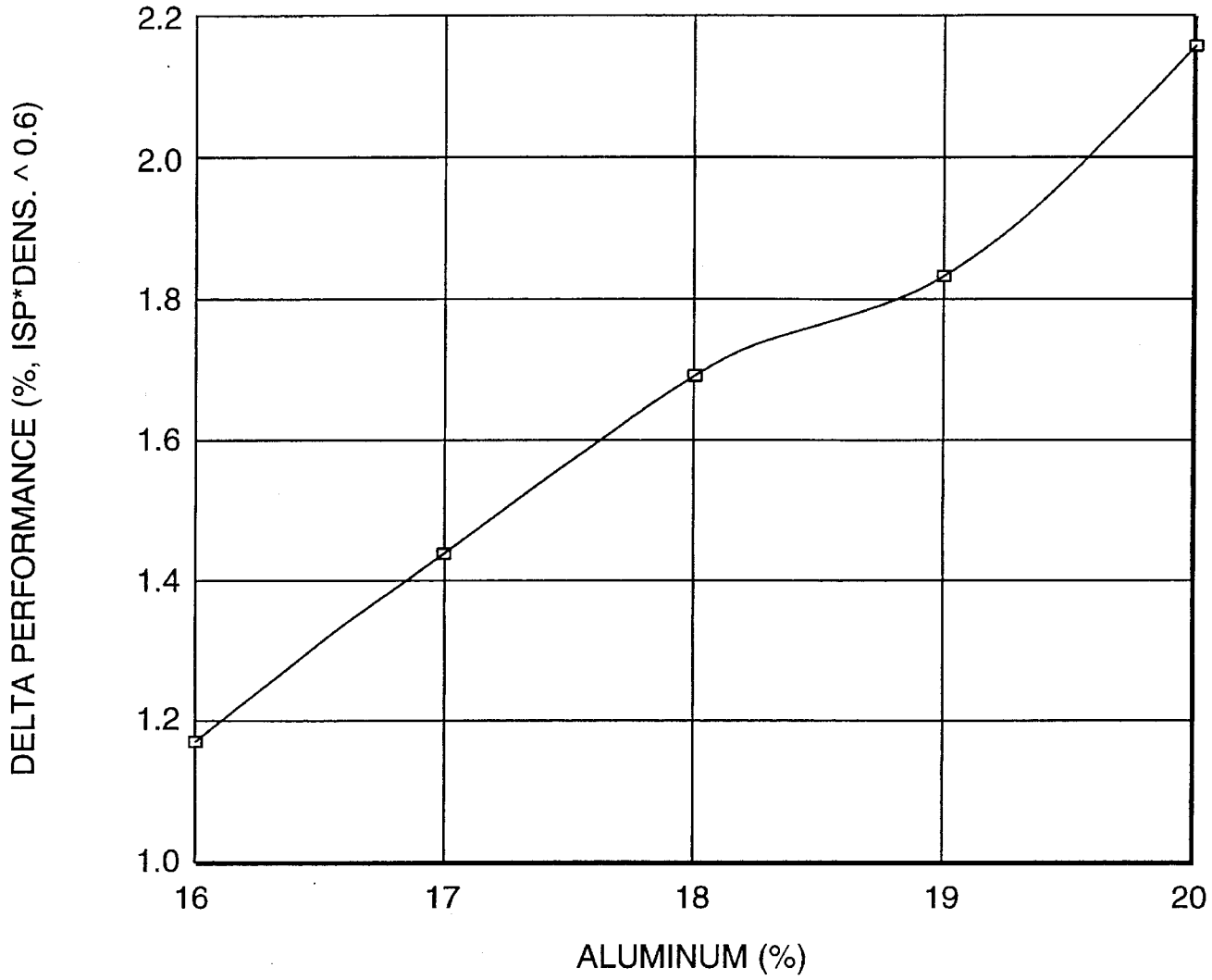
FIG. 2 is a graph showing the change in performance as a function of percentage of aluminum in a PBAN propellant composition using diepoxyoctane as the curative.

FIG. 2 plots the theoretical change in performance with an increase in the aluminum level with total solids at 88%. Again, it can be seen that markedly improved performance is achievable using the present invention over conventional propellants of this type which contain less than 85% solids.

Figure 3:
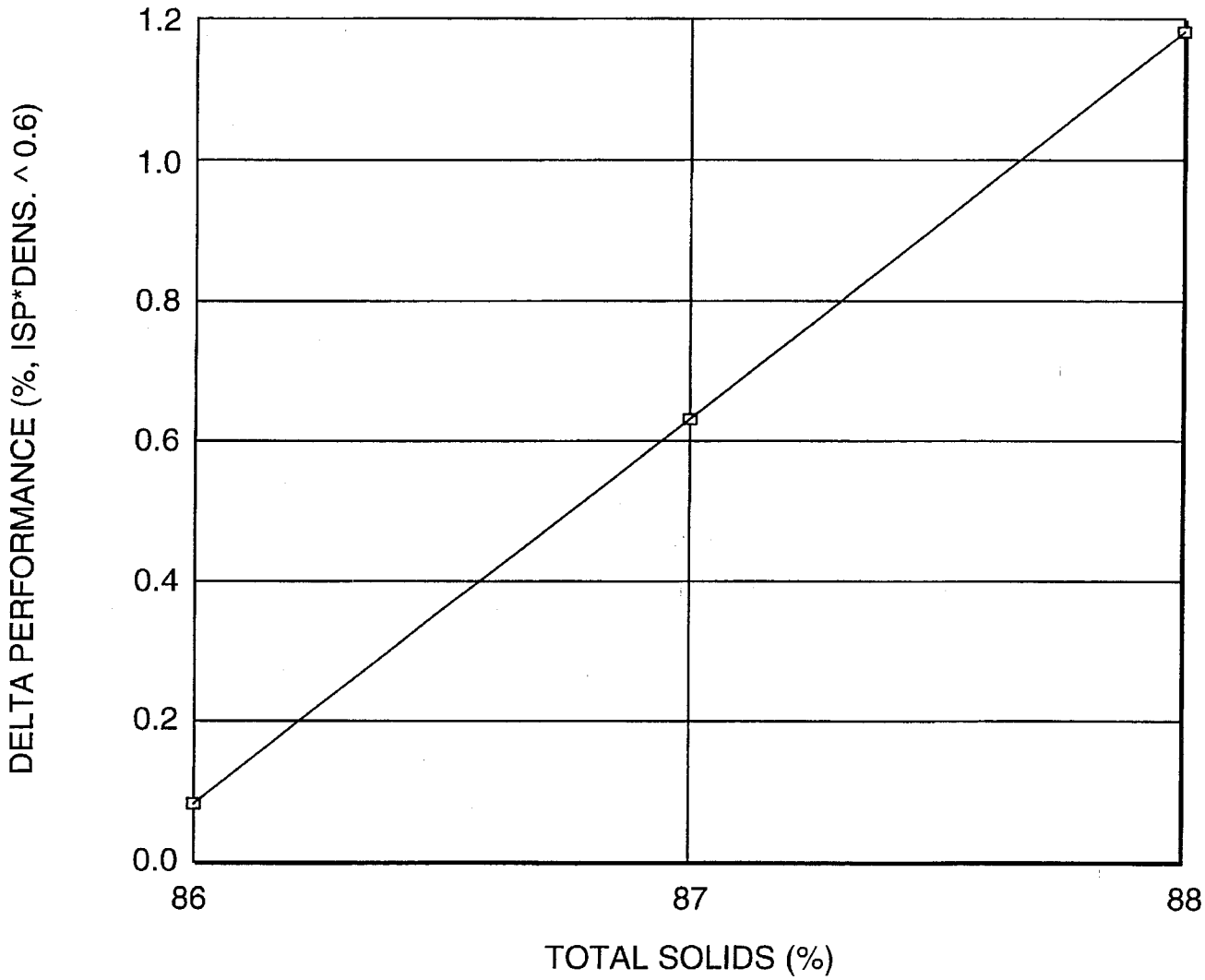
FIG. 3 is a graph showing the change in performance as a function of total solids in a PBAN propellant composition using diepoxyoctane as the curative.

FIG. 3 plots the theoretical change in performance with increasing total solids. The propellant is a diepoxyoctane cured PBAN propellant having 16% aluminum. This figure illustrates that performance is improved by increasing total solids, even if the level of aluminum in the propellant is held constant.

EXAMPLES

The following examples are given to illustrate various embodiments which have been made or may be made in accordance with the present invention. These examples are given by way of example only, and it is to be understood that the following examples are not comprehensive or exhaustive of the many types of embodiments of the present invention which can be prepared in accordance with the present invention.

EXAMPLE 1

In this example, a conventional high solids PBAN propellant was prepared for purposes of comparison. The propellant contained the following ingredients in the following proportions:

| | Weight % |
|---|---|
| PBAN | 10.380 |
| ECA | 1.620 |
| $Fe_2O_3$ | 0.250 |
| AP (200μ) | 47.425 |
| AP (20μ) | 20.325 |
| Al (25μ) | 20.000 |

The propellant formulation, having total solids of 88%, was observed to have an end of mix viscosity of 52 Kp at 144° F. End of mix viscosities of this magnitude generally render the propellant formulation unusable.

EXAMPLE 2

In this example, a propellant within the scope of the present invention was formulated using diepoxy octane as the curing agent. Diepoxy octane has the following structure:

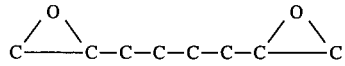

The propellant contained the following ingredients in the following proportions:

| | Weight % |
|---|---|
| PBAN | 11.266 |
| diepoxy octane | 0.734 |

-continued

| | Weight % |
|---|---|
| $Fe_2O_3$ | 0.250 |
| AP (200μ) | 47.425 |
| AP (20μ) | 20.325 |
| Al (25) | 20.000 |

The propellant formulation, which had total solids loading of 88%, was observed to have an end of mix viscosity of 28.0 Kp at 144° F.

EXAMPLE 3

In this example, a propellant within the scope of the present invention was formulated using ethylene glycoldiglycidyl ether as the curing agent. Ethylene glycoldiglycidyl ether has the following structure:

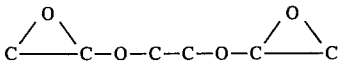

The propellant contained the following ingredients in the following proportions:

| | Weight % |
|---|---|
| PBAN | 11.062 |
| ethylene glycol - diglycidyl ether | 0.888 |
| $Fe_2O_3$ | 0.250 |
| AP (200μ) | 47.425 |
| AP (20μ) | 20.325 |
| Al (25μ) | 20.000 |
| MgO | 0.05 |

The propellant formulation, which had total solids loading of 88.05%, was observed to have an end of mix viscosity of 35.2 Kp at 146° F. This example also illustrates the effect of including MgO as a cure catalyst in the propellant mix.

EXAMPLE 4

In this example, a propellant within the scope of the present invention was formulated. The propellant contained the following ingredients in the following proportions:

| | Weight % |
|---|---|
| PBAN | 11.216 |
| diepoxy octane | 0.734 |
| $Fe_2O_3$ | 0.250 |
| AP (200μ) | 47.425 |
| AP (20μ) | 20.325 |
| Al (25μ) | 20.000 |
| MgO | 0.05 |

The propellant formulation, which had total solids loading of 88.05%, was observed to have an end of mix viscosity of 36 Kp at 144° F. This example also illustrates the effect of including MgO as a cure catalyst in the propellant mix.

SUMMARY

In summary, the present invention provides methods and compositions for increasing the solids loading of high output solid rocket motor propellants. The present invention provides solid rocket motor propellant formulations which are capable of containing 86% or more total solids and which are still processible. Such propellants include a PBAN binder and a diepoxide curing agent. The use of the diepoxide curing agent reduces viscosity of the mixture, thus allowing total solids to be increased, while preserving a processible propellant.

The invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A solid rocket motor propellant comprising the products of combining:

a butadiene-acrylonitrile-acrylic acid terpolymer binder (PBAN);

a curative selected from the group consisting of diepoxides having 4 to 10 carbon atoms;

a solid oxidizer salt; and a solid fuel;

wherein the solid oxidizer salt and solid fuel together comprise not less than about 86% by weight of the propellant composition.

2. A solid rocket motor propellant as defined in claim 1 wherein said diepoxides are selected from the group consisting of aliphatic, cycloaliphatic, mono-aromatic, or heterocyclic diepoxides.

3. A solid rocket motor propellant as defined in claim 1 wherein said propellant comprises from about 14% to about 7% butadiene-acrylonitrile-acrylic acid terpolymer binder (PBAN).

4. A solid rocket motor propellant as defined in claim 1 wherein said propellant comprises from about 0.2% to about 2.0% diepoxide curing agent.

5. A solid rocket motor propellant as defined in claim 1 comprising from about 65% to about 92% solid oxidizing salt.

6. A solid rocket motor propellant as defined in claim 1 comprising up to 25% solid fuel.

7. A solid rocket motor propellant as defined in claim 1 wherein the solid oxidizer salt is ammonium perchlorate.

8. A solid rocket motor propellant as defined in claim 1 wherein the solid fuel is aluminum.

9. A high solids rocket motor propellant comprising:

from about 7.0% to about 14.0% butadiene-acrylonitrile-acrylic acid terpolymer (PBAN) binder;

from about 0.2% to about 2.0% curative selected from the group consisting of diepoxides having 4 to 10 carbon atoms;

from about 65% to about 92% solid oxidizing salt;

from about 0% to about 25% solid fuel;

wherein oxidizing salt and said solid fuel together comprise from about 86% to about 92% by weight of the propellant.

10. A high solids rocket motor propellant as defined in claim 9 wherein said diepoxides are selected from the group consisting of aliphatic, cycloaliphatic, mono-aromatic, or heterocyclic diepoxides.

11. A high solids rocket motor propellant as defined in claim 9 wherein the solid oxidizer salt is ammonium perchlorate.

12. A high solids rocket motor propellant as defined in claim 9 wherein the solid fuel is aluminum.

13. A method of formulating a high solids PBAN rocket motor propellant comprising the step of combining the following:

a butadiene-acrylonitrile-acrylic acid terpolymer (PBAN) binder;

a curative selected from the group consisting of diepoxides having 4 to 10 carbon atoms;

a solid oxidizer salt;

a solid fuel;

wherein the solid oxidizer salt and solid fuel together comprises from about 86% to about 92% by weight of the propellant composition.

14. A method of formulating a high solids PBAN rocket motor propellant as defined in claim 13 wherein the end of mix viscosity of the formulation is less than 40 Kp.

15. A method of formulating a high solids PBAN rocket motor propellant as defined in claim 13 wherein the end of mix viscosity of the formulation is in the range of from about 20 Kp to about 30 Kp.

16. A method of formulating a high solids PBAN rocket motor propellant as defined in claim 13 wherein said diepoxides are selected from the group consisting of aliphatic, cycloaliphatic, mono-aromatic, or heterocyclic diepoxides.

17. A method of formulating a high solids PBAN rocket motor propellant as defined in claim 13 wherein said propellant comprises from about 7.0% to about 14.0% PBAN.

18. A method of formulating a high solids PBAN rocket motor propellant as defined in claim 13 wherein said propellant comprises from about 0.2% to about 2.0% diepoxide curing agent.

19. A method of formulating a high solids PBAN rocket motor propellant as defined in claim 13 wherein said propellant comprises from about 65% to about 92% solid oxidizing salt.

20. A method of formulating a high solids PBAN rocket motor propellant as defined in claim 13 wherein said propellant comprises from about 0% to about 25.0% solid fuel.

21. A method of formulating a high solids PBAN rocket motor propellant as defined in claim 13 wherein the solid oxidizer salt is ammonium perchlorate.

22. A method of formulating a high solids PBAN rocket motor propellant as defined in claim 13 wherein the solid fuel is aluminum.

* * * * *